US010186782B2

(12) United States Patent
Takahashi

(10) Patent No.: US 10,186,782 B2
(45) Date of Patent: Jan. 22, 2019

(54) ANTENNA AND WIRELESS COMMUNICATION APPARATUS

(71) Applicant: NEC CORPORATION, Tokyo (JP)

(72) Inventor: Yoshihide Takahashi, Tokyo (JP)

(73) Assignee: NEC CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 15/746,491

(22) PCT Filed: Jul. 28, 2016

(86) PCT No.: PCT/JP2016/003504
§ 371 (c)(1),
(2) Date: Jan. 22, 2018

(87) PCT Pub. No.: WO2017/022224
PCT Pub. Date: Feb. 9, 2017

(65) Prior Publication Data

US 2018/0212329 A1 Jul. 26, 2018

(30) Foreign Application Priority Data

Aug. 5, 2015 (JP) ..... 2015-155339

(51) Int. Cl.
*H01Q 1/24* (2006.01)
*H01Q 9/28* (2006.01)
*H01Q 21/08* (2006.01)

(52) U.S. Cl.
CPC ..... *H01Q 9/28* (2013.01); *H01Q 1/246* (2013.01); *H01Q 21/08* (2013.01)

(58) Field of Classification Search
CPC ..... H01Q 1/246; H01Q 9/28; H01Q 21/08
See application file for complete search history.

(56) References Cited

U.S. PATENT DOCUMENTS 7,498,993 B1 * 3/2009 Lee ..... H01Q 1/1271 343/713
2008/0169993 A1 * 7/2008 Matsuzawa ..... H01Q 1/1242 343/814

(Continued)

FOREIGN PATENT DOCUMENTS

JP 2002-141732 A 5/2002
JP 2004-363693 A 12/2004

(Continued)

OTHER PUBLICATIONS

International Search Report for PCT/JP2016/003504 dated Oct. 4, 2016.

*Primary Examiner* — Simon Nguyen
(74) *Attorney, Agent, or Firm* — Sughrue Mion, PLLC

(57) ABSTRACT

First and second radiation elements are arranged on a first face in a Z axis direction. A third radiation element is formed on a second face to be interposed between the first and second radiation elements. A fourth radiation element is formed on the second face to be interposed between the first and second radiation elements. A micro strip line connects the first radiation element and the second radiation element and is formed on the first face to extend in the Z axis direction. A first element connection part is formed on the second face to overlap with the micro strip line in a Y axis direction, and to have a width wider than that of the micro strip line. A feeding unit connects a coaxial cable supplying power from the outside to the micro strip line and the fourth radiation element.

13 Claims, 17 Drawing Sheets

(56) References Cited

U.S. PATENT DOCUMENTS

| | | | | |
|---|---|---|---|---|
| 2010/0302111 | A1* | 12/2010 | Kotaka | H01Q 1/243<br>343/702 |
| 2011/0148729 | A1* | 6/2011 | Ro | H01Q 11/06<br>343/792.5 |

FOREIGN PATENT DOCUMENTS

| | | | |
|---|---|---|---|
| JP | 2007-142570 | A | 6/2007 |
| JP | 2007-142988 | A | 6/2007 |
| WO | 2012/164782 | A1 | 12/2012 |

* cited by examiner

ANTENNA AND WIRELESS COMMUNICATION APPARATUS

CROSS REFERENCE TO RELATED APPLICATIONS

This application is a National Stage of International Application No. PCT/JP2016/003504 filed Jul. 28, 2016, claiming priority based on Japanese Patent Application No. 2015-155339 filed Aug. 5, 2015, the contents of all of which are incorporated herein by reference in their entirety.

TECHNICAL FIELD

The present invention relates to an antenna and a wireless communication apparatus.

BACKGROUND ART

Recently, devices such as a mobile phone that uses large-capacity wireless communication have been spread. In such wireless communication, it is necessary to use an omnidirectional antenna capable of isotropically transmitting a radio wave as a base station antenna in order not to limit a position of a mobile terminal with respect to a base station.

As an example of such antenna, an omnidirectional antenna that can prevent a deviation from a maximum radiation direction position in a vertical plane directionality and can suppress a level deviation in a horizontal plane directionality, has been proposed (Patent Literature 1). FIG. 15 is a front view illustrating a configuration of an antenna 700 according to Patent Literature 1. FIG. 16 is a back view illustrating the configuration of the antenna 700 according to Patent Literature 1.

The antenna 700 includes half wavelength dipole antenna elements 710A and 710B. The dipole antenna elements 710A and 710B are vertically arranged in such a manner that longitudinal axes of those are aligned in a vertical line and the dipole antenna elements 710A and 710B are not to contact each other. A coaxial cable 740 can be inserted between the upper dipole antenna element 710A and the lower dipole antenna element 710B. The element conductors 711 and 712 constituting the dipole antenna elements 710A and 710B are formed of a metal foil adhered to a dielectric substrate 720. The element conductor 711 is formed on a top face of the dielectric substrate 720 and the element conductor 712 is formed on a back face of the dielectric substrate 720.

On the dielectric substrate 720, a dual-distribution feed line 730 is formed to be parallel to the longitudinal axis of the dipole antenna elements 710A and 710B. The dual-distribution feed line 730 includes a conductor line 731 formed on the top face of the dielectric substrate 720 and the conductor line 732 formed on the back face of the dielectric substrate 720 to face the conductor line 731. The dual-distribution feed line 730 is arranged at a position laterally away from the longitudinal axis of the dipole antenna elements 710A and 710B (on a right side in FIG. 15) by a predetermined distance. An upper end and lower end of the conductor line 731 are each connected to the element conductors 711 of the dipole antenna elements 710A and 710B. An upper end and lower end of the conductor line 732 are each connected to the element conductors 712 of the dipole antenna elements 710A and 710B The coaxial cable 740 serving as a main feed line is closely disposed on the top face of the dielectric substrate 720. A core conductor of the coaxial cable 740 is connected to a branch point of the conductor line 731 and an outer conductor of the coaxial cable 740 is connected to a branch point of the conductor line 732. The coaxial cable 740 passes between the element conductor 712 of the dipole antenna element 710A and the element conductor 711 of the dipole antenna element 710B and then is guided downward to be parallel to the longitudinal central axis of the dipole antenna element 710B. In other words, the coaxial cable 740 is disposed in such a manner that a part of the coaxial cable 740 guided downward is located on a left side of the dipole antenna element 710B in FIG. 15. A distance between the longitudinal central axis of the dipole antenna element 710B and the coaxial cable 740 substantially coincides with a distance between the longitudinal central axis of the dipole antenna element 710B and the dual-distribution feed line 730. Therefore, the coaxial cable 740 and the dual-distribution feed line 730 are positioned substantially symmetrically with respect to the dipole antenna element 710B that is a center.

In the antenna 700, the dipole antenna elements 710A and 710B each radiate radio waves that are omnidirectional in the horizontal plane and the dual-distribution feed line 730 and the coaxial cable 740 in the vicinity of the dipole antenna elements 710A and 710B function as a reflective conductor. Since the dual-distribution feed line 730 and the coaxial cable 740 are positioned substantially symmetrically with respect to the dipole antenna element 710B that is the center, deteriorations of radiation level due to reflective functions of the dual-distribution feed line 730 and the coaxial cable 740 are cancelled. Therefore, a level deviation that is a difference between the maximum radiation power level and the minimum radiation power level decreased.

Besides, for a patch array antenna, a parallel power feeding method for an antenna element, which can realize miniaturization and a wide bandwidth, has been proposed (Patent Literature 2).

CITATION LIST

Patent Literature

[Patent Literature 1] Japanese Unexamined Patent Application Publication No. 2007-142988

[Patent Literature 2] Japanese Unexamined Patent Application Publication No. 2007-142570

SUMMARY OF INVENTION

Technical Problem

However, the inventor has found that the omnidirectional antenna described above has the following problems. As illustrated in FIGS. 15 and 16, the configurations of the dipole antenna elements 710A and 710B on the right side and left side of those longitudinal central axis are not line symmetrical. Thus, a deviation of antenna gain occurs due to this asymmetry. FIG. 17 illustrates a gain in the horizontal plane of the above-described omnidirectional antenna disclosed in Patent Literature 1. As illustrated in FIG. 17, a deviation in the gain of the antenna 700 occurs between the right side and left side of the antenna 700.

The present invention has been made in view of the aforementioned circumstances and aims to provide an antenna having excellent omnidirectionality by suppressing a deviation due to azimuth.

Solution to Problem

An aspect of the present invention is an antenna including: first and second radiation elements formed on a first face parallel to a first direction and a second direction orthogonal to the first direction, and arranged in the first direction; a third radiation element formed on a second face parallel to the first face and separated from the first face in a third direction orthogonal to the first and second directions so as to be interposed between the first radiation element and the second radiation element; a fourth radiation element formed on the second face to be interposed between the first radiation element and the second radiation element and to be closer to the second radiation element than the third radiation element; a first line connecting the first radiation element and the second radiation element and formed on the first face to extend in the first direction; a first element connecting part formed on the second face to overlap with the first line in the third direction, connecting the third radiation element and the fourth radiation element, and having a width in the second direction wider than that of the first line; and a feeding unit connecting a coaxial cable feeding power from the outside to the first line and the fourth radiation element, in which the coaxial cable is connected to the feeding unit to extend from the feeding unit in the second direction and to pass through a hole disposed in one of the first line and the fourth radiation element, and one of an inner conductor and an outer conductor of the coaxial cable is electrically connected to the first line and the other of the inner conductor and the outer conductor of the coaxial cable is electrically connected to the fourth radiation element.

An aspect of the present invention is a wireless communication apparatus including; an antenna configured to be capable of corresponding to a plurality of frequencies; a base band unit configured to output a base band signal and receive a signal generated by demodulating a received signal; and a RF unit configured to modulate the base band signal and output a transmission signal to the antenna, and to output the signal generated by demodulating the received signal received from the antenna to the base band unit, in which the antenna includes: first and second radiation elements formed on a first face parallel to a first direction and a second direction orthogonal to the first direction and arranged in the first direction; a third radiation element formed on a second face parallel to the first face and separated from the first face in a third direction orthogonal to the first and second directions so as to be interposed between the first radiation element and the second radiation element; a fourth radiation element formed on the second face to be interposed between the first radiation element and the second radiation element and to be closer to the second radiation element than the third radiation element; a first line connecting the first radiation element and the second radiation element and formed on the first face to extend in the first direction; a first element connecting part formed on the second face to overlap with the first line in the third direction, connecting the third radiation element and the fourth radiation element, and having a width in the second direction wider than that of the first line; and a feeding unit connecting a coaxial cable feeding power from the outside to the first line and the fourth radiation element, the coaxial cable is connected to the feeding unit to extend from the feeding unit in the second direction and to pass through a hole disposed in one of the first line and the fourth radiation element, and one of an inner conductor and an outer conductor of the coaxial cable is electrically connected to the first line and the other of the inner conductor and the outer conductor of the coaxial cable is electrically connected to the fourth radiation element.

Advantageous Effects of Invention

According to the present invention, it is possible to provide an antenna having excellent omnidirectionality by suppressing a deviation due to azimuth.

DESCRIPTION OF EMBODIMENTS

Figure 1:
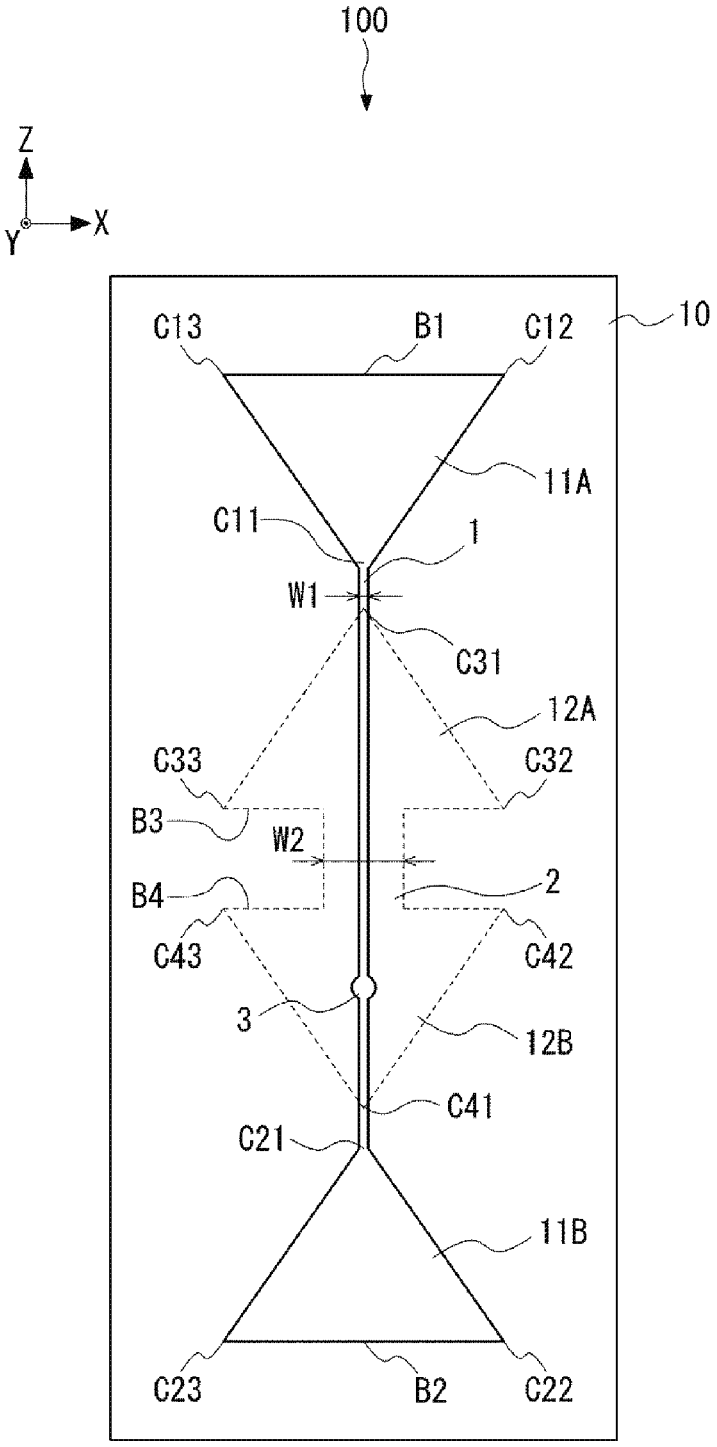
FIG. 1 is a top view of an antenna according to a first exemplary embodiment.

Exemplary embodiments of the present invention will be described below with reference to the drawings. The same components are denoted by the same reference numerals throughout the drawings, and a repeated explanation is omitted as needed.

First Exemplary Embodiment

Figure 2:
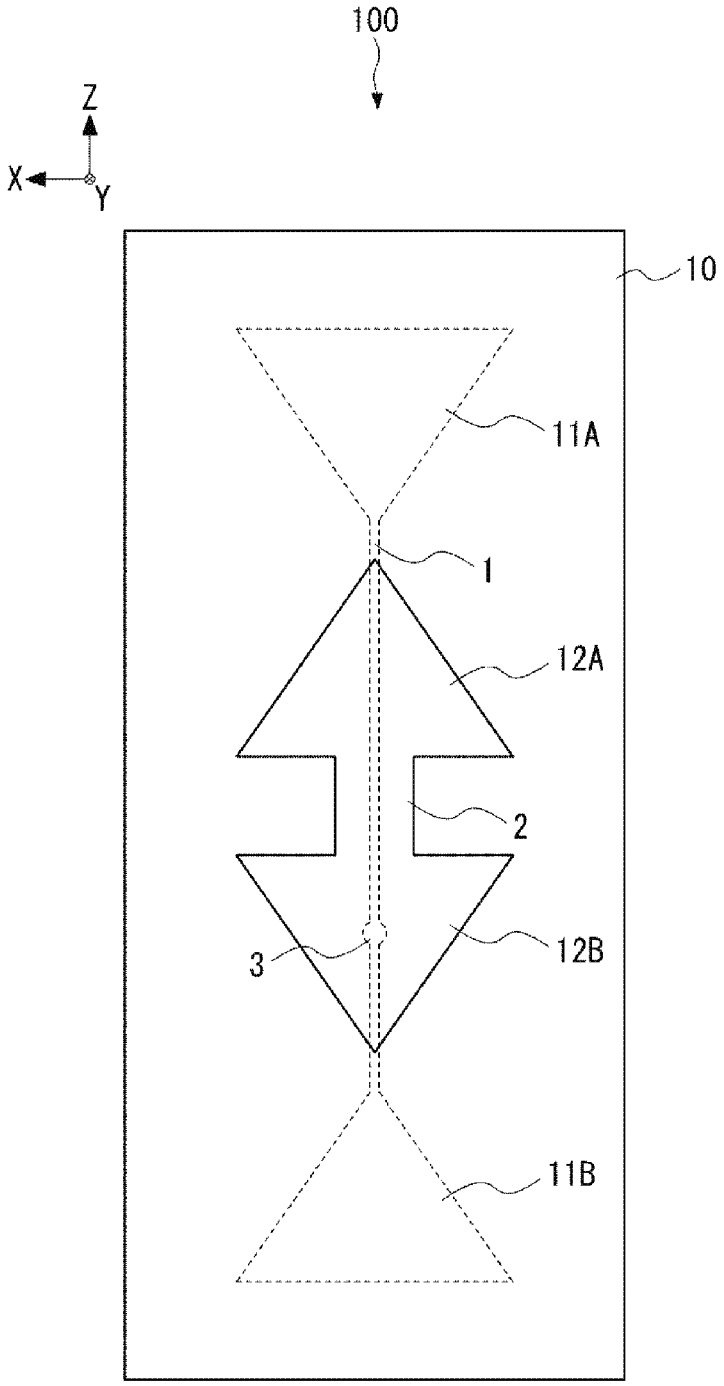
FIG. 2 is a bottom view of the antenna according to the first exemplary embodiment.

An antenna according to a first exemplary embodiment will be described. An antenna 100 according to the first exemplary embodiment is configured as an omnidirectional antenna. FIG. 1 is a top view of the antenna 100 according to the first exemplary embodiment. FIG. 2 is a bottom view of the antenna 100 according to the first exemplary embodiment. In FIGS. 1 and 2, a horizontal direction of the drawing is an X axis, a vertical direction of the drawing is a Y axis, and a direction perpendicular to the drawings is a Z plane. The X axis direction is also referred to as a second direction. The Y axis direction is also referred to as a third direction. The Z axis direction is also referred to as a first direction.

The antenna 100 is the omnidirectional antenna having an isotropic radiation pattern in an X-Y plane. The antenna 100 is configured, for example, by forming a radiation element on both faces of a printed circuit board 10. The antenna 100 includes radiation elements 11A, 11B, 12A and 12B, a micro strip line 1, an element connection part 2, and a feeding unit 3. In the present exemplary embodiment, triangles that are shapes of the radiation elements 11A, 11B, 12A and 12B are congruent shapes. Hereinafter, the radiation elements 11A, 11B, 12A and 12B are also referred to as first to fourth radiation elements, respectively. The micro strip line 1 is also referred to as a first line. The element connection part 2 is also referred to as a first element connection part.

The radiation elements 11A, 11B, 12A and 12B are triangular radiation elements constituting a bow-tie antenna in a plane (X-Y plane in FIGS. 1 and 2). The radiation elements 11A, 11B, 12A and 12B, the micro strip line 1, the element connection part 2, and the feeding unit 3 can be formed of a metal film (e.g. a copper film). Thus, the radiation elements 11A, 11B, 12A and 12B, the micro strip line 1, the element connection part 2, and the feeding unit 3 can be formed on the printed circuit board 10 as the metal film by using a manufacturing technology of the printed circuit board.

For example, the radiation elements 11A and 11B, and the micro strip line 1 are formed on a top face of the printed circuit board 10 (It is a Y(+) side face of the printed circuit board 10 in FIGS. 1 and 2, and also referred to as a first face.). The radiation element 11A is arranged in such a manner that, with respect to a base B1 of the triangle that connects a vertex C12 and a vertex C13 and is parallel to the X axis, a vertex C11 separated from the base is arranged on a Z(−) side. The radiation element 11A and the radiation element 11B are disposed to be line-symmetric with respect to each other with reference to a line parallel to the X axis passing through a center point CNT of the antenna 100. In other words, the radiation element 11B is arranged in such a manner that, with respect to a base B2 of the triangle that connects a vertex C22 and a vertex C23 and is parallel to the X axis, a vertex C21 separated from the base is arranged on a Z(+) side. Additionally, the radiation element 11A and the radiation element 11B are disposed in such a manner that the vertex C11 and the vertex C21 facing each other across the center point CNT are separated in the Z axis direction by approximately one wavelength of an effective wavelength λeff of an electromagnetic wave propagating through the antenna 100. Then, the micro strip line 1 extending along the Z axis direction connects between the vertex C11 and the vertex C21.

For example, the radiation elements 12A and 12B, and the element connection part 2 are formed on a back face of the printed circuit board 10 (It is a Y(−) side face of the printed circuit board 10 in FIGS. 1 and 2, and also referred to as a second face.). The radiation element 12A is arranged in such a manner that, with respect to a base B3 of the triangle that connects a vertex C32 and a vertex C33 and is parallel to the X axis, a vertex C31 separated from the base is arranged on the Z(+) side. Here, the radiation element 12B is arranged in such a manner that the vertex C31 of the radiation element 12A is separated from the vertex C11 of the radiation element 11A toward the Z(−) side. The radiation element 12B is arranged in such a manner that, with respect to a base B4 of the triangle that connects a vertex C42 and a vertex C43 and is parallel to the X axis, a vertex C41 separated from the base is arranged on the Z(−) side. Here, the radiation element 12A is arranged in such a manner that the vertex C41 of the radiation element 12B is separated from the vertex C21 of the radiation element 11B toward the Z(+) side.

The bases B1 to B4 are also referred to as first to fourth sides.

Figure 3:
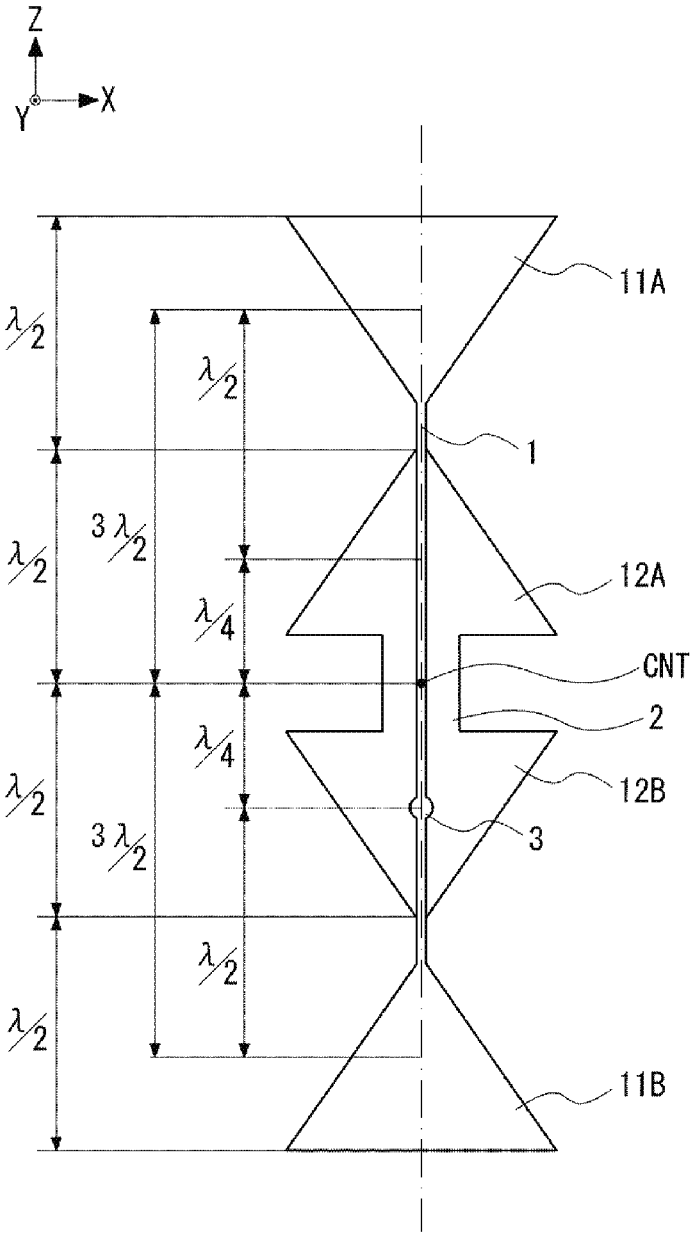
FIG. 3 is a perspective view illustrating a configuration of the antenna according to the first exemplary embodiment when the antenna is viewed from a Y(+) side.

FIG. 3 is a perspective view illustrating the configuration of the antenna 100 according to the first exemplary embodiment when the antenna 100 is viewed from the Y(+) side. As described above, as illustrated in FIG. 3, when the antenna 100 is viewed from the Y(+) side, the antenna 100 is configured in such a manner that the radiation elements 11A, 11B, 12A and 12B are aligned in the Z axis direction and the radiation elements 12A and 12B are interposed between the radiation element 11A and the radiation element 11B. The radiation element 12A and the radiation element 12B are connected by the element connection part 2 that is line-symmetrical with reference to the line parallel to the X axis and passing through the center point CNT of the antenna 100. The element connection part 2 is configured in such a manner that a width W2 of the element connection part 2 in the X axis direction is wider than a width W1 of the micro strip line 1 in the X axis direction (W2>W1).

In the present configuration, the radiation element 11A and the radiation element 11B are connected by the micro strip line 1. The radiation element 12A and the radiation element 12B are connected by the element connection part 2. Thus, the radiation element 11A and the radiation element 11B constitute one dipole antenna, and the radiation element 12A and the radiation element 12B constitute one dipole antenna.

Figure 4:
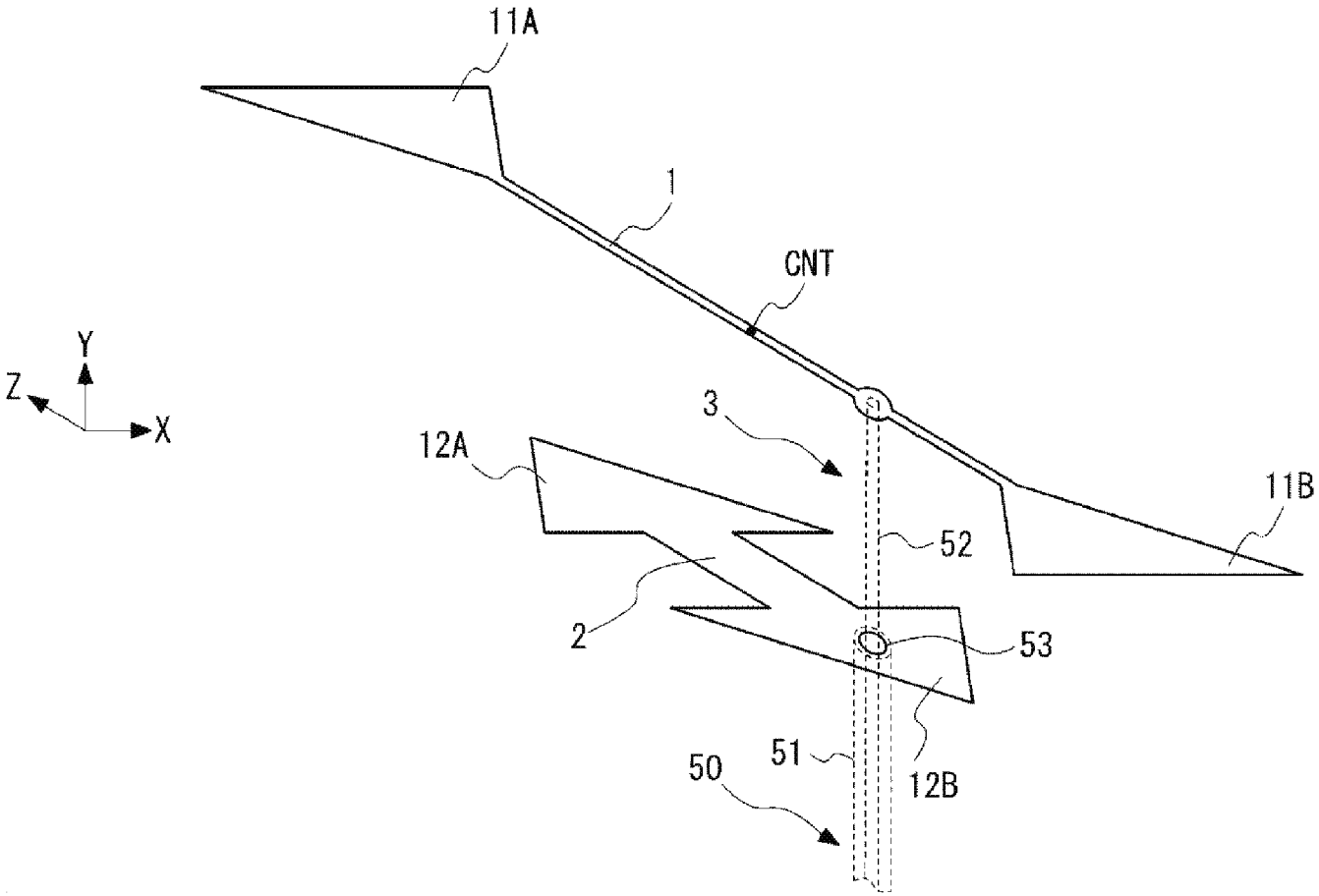
FIG. 4 is a perspective view illustrating the configuration of the antenna according to the first exemplary embodiment.

The feeding unit 3 is disposed in the micro strip line 1 and the radiation element 12B. FIG. 4 is a perspective view illustrating the configuration of the antenna 100 according to the first exemplary embodiment. Power is fed to the feeding unit 3, for example, by a coaxial cable connected from the Y axis (+) side, or the like. Here, the coaxial cable can be electrically connected to the radiation element 12B by passing through a hole disposed in the micro strip line and a hole penetrating the printed circuit board, for example. More specifically, an inner conductor of the coaxial cable is electrically connected to the micro strip line 1 and an outer conductor of the coaxial cable is electrically connected to the radiation element 12B. In the example of FIG. 4, an outer conductor 51 of a coaxial cable 50 extending from the Y(−) direction is connected to the radiation element 12B. An inner conductor 52 of the coaxial cable 50 passes through a hole 53 disposed in the radiation element 12B, reaches the micro strip line 1, and is connected to the micro strip line 1.

In this case, the radiation elements 12A and 12B also function as a ground plate for the micro strip line 1. Thus, the radiation elements 11A and 11B are fed through the micro strip line 1, the radiation elements 12A and 12B are electrically excited by the radiation elements 11A and 11B, and thereby the radiation elements 11A, 11B, 12A and 12B can function as the radiation element. According to the configuration described above, it is possible to dispose the micro strip line 1 and the element connection part 2 to overlap in the Y axis direction.

As illustrated in FIG. 3, the feeding unit 3 is disposed at a position shifted from the center point CNT in the Z axis direction by approximately ¼ of the above-described effective wavelength λeff. Therefore, in the present configuration, a distance between the feeding unit 3 and a center of the radiation element 11A is approximately equal to the effective wavelength λeff, and a distance between the feeding unit 3 and a center of the radiation element 11B is approximately equal to ½ of the effective wavelength λeff. As a result, when a radio wave radiated from the radiation element 11A and a radio wave radiated from the radiation element 11B interfere with each other at a position separated from the antenna 100, phases of these radio waves are the same. Accordingly, since the radio waves radiated from the radiation elements 11A and 12A and the radio waves radiated from the radiation elements 11B and 12B strengthen each other, it is advantageous in maximizing output power of the antenna.

In the present configuration, a distance between the feeding unit 3 and a center of the radiation element 12A is approximately ½ of the effective wavelength λeff, and a distance between the feeding unit 3 and a center of the radiation element 12B is approximately zero. As a result, the radiation elements 12A and 12B can function as the grounds for the radiation elements 11A and 11B, respectively. Accordingly, the radio wave radiated from the radiation element 12A and the radio wave radiated from the radiation element 12B interfere with each other at a position separated from the antenna 100, phases of these radio waves are the same. Therefore, since the radio wave radiated from the radiation element 12A and the radio wave radiated from the radiation element 12B strengthen each other, it is advantageous in maximizing the output power of the antenna.

Further, in the present configuration, since parallel feeding is performed for the dipole antennas arranged on the Z axis, it is possible to suppress a deviation of the maximum radiation direction in the vertical plane to the minimum within a practically acceptable range even when an operating frequency deviates from a designed center frequency. As a result, it is possible to operate in a wide band around a design center.

As described above, as illustrated in FIG. 1 and FIG. 2, according to the present configuration, the antenna having the shape that is line-symmetrical with reference to the Z axis can be provided. In this antenna, due to this symmetry, it is possible to achieve more excellent omnidirectional characteristics as compared to general antennas in the X-Y plane (a horizontal plane).

Figure 5:
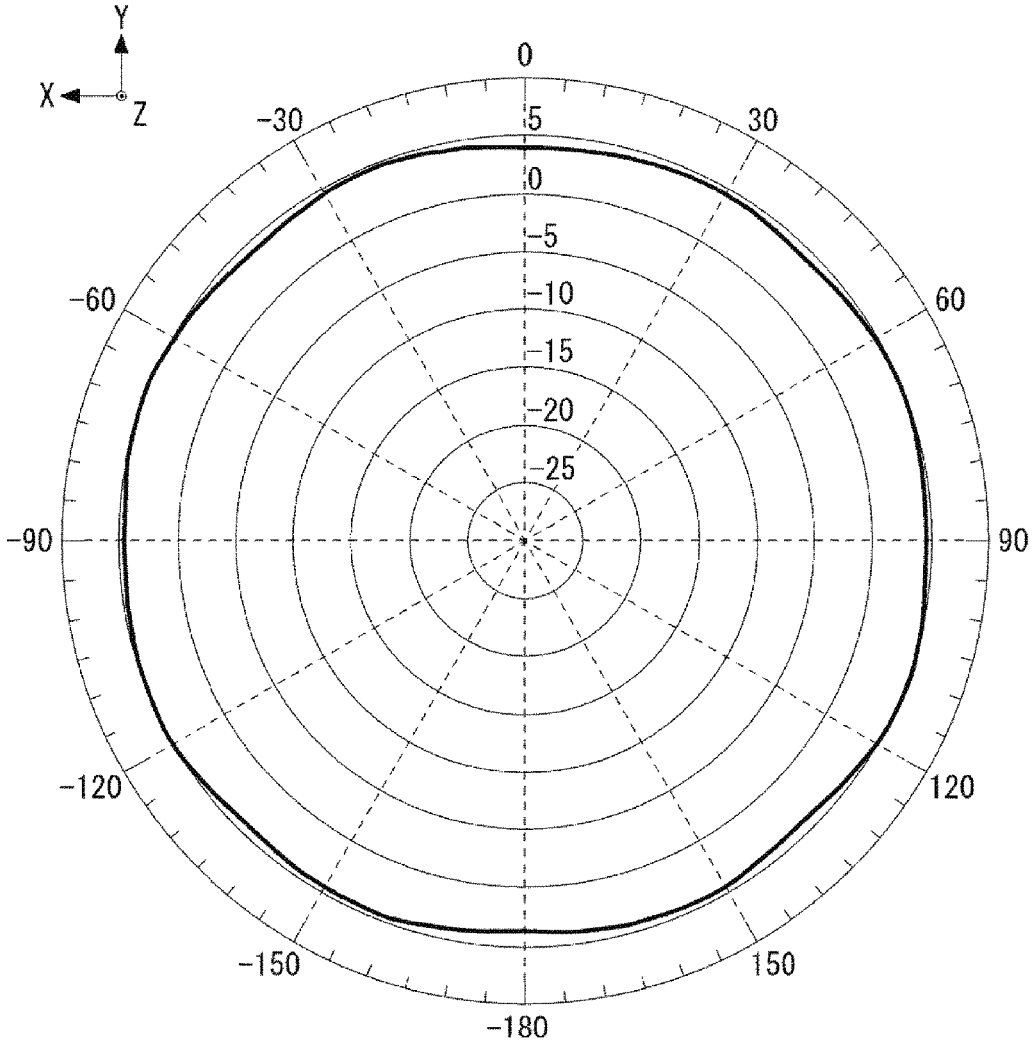
FIG. 5 illustrates a gain of the antenna according to the first exemplary embodiment at a frequency of 4.8 GHz.
Figure 6:
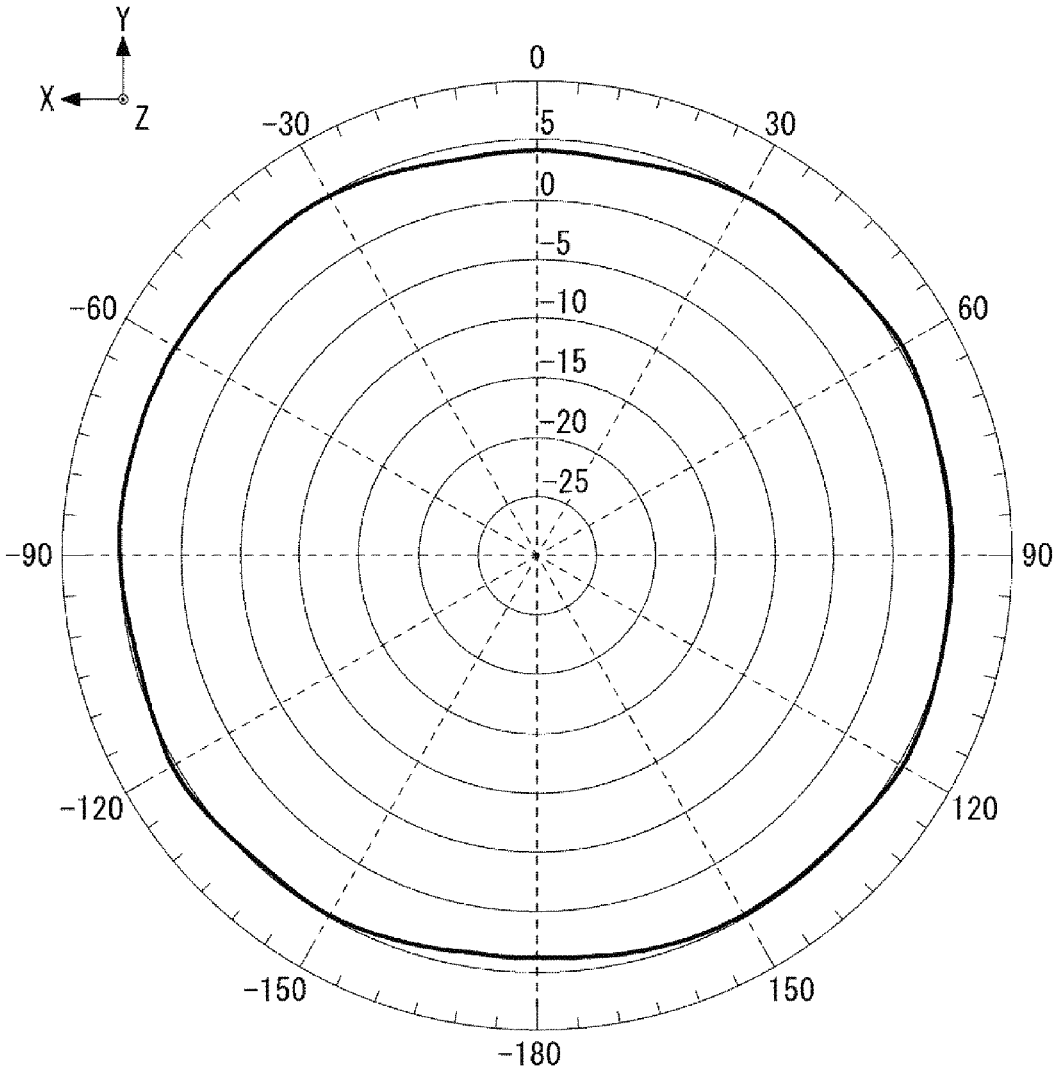
FIG. 6 illustrates a gain of the antenna according to the first exemplary embodiment at a frequency of 5.3 GHz.
Figure 7:
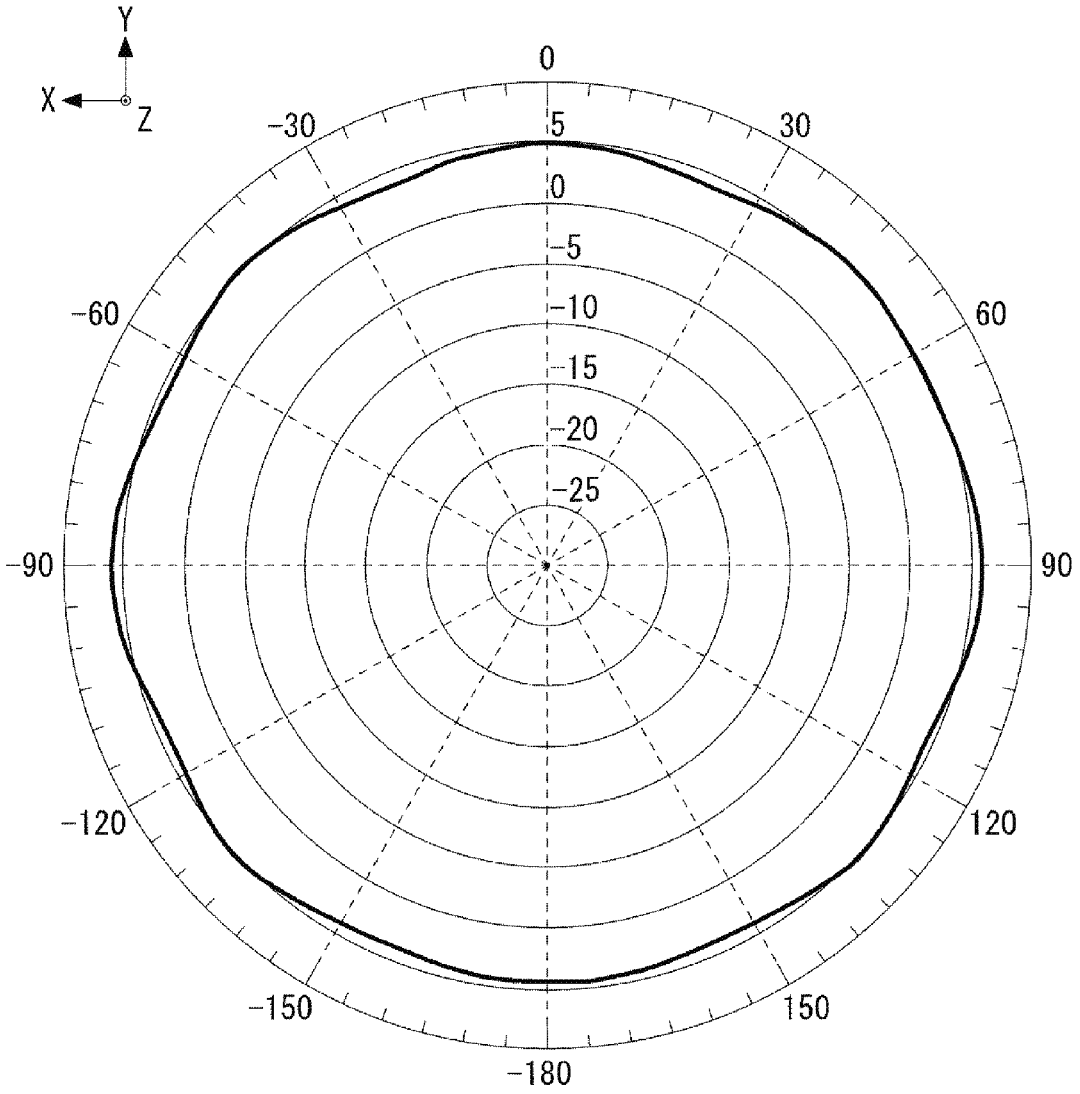
FIG. 7 illustrates a gain of the antenna according to the first exemplary embodiment at a frequency of 5.8 GHz.

An example of measurement result of a gain of the antenna 100 will be described below. FIGS. 5 to 7 illustrate the gains of the antenna 100 according to the first exemplary embodiment at frequencies of 4.8 GHz, 5.3 GHz, and 5.8 GHz. In FIGS. 5 to 7, a circumferential direction represents an azimuth direction and a diameter direction represents the gain (dBi) of the antenna 100. As illustrated in FIGS. 5 to 7, it has been confirmed that the antenna 100 achieves high omnidirectionality in a wide band of 4.8 to 5.8 GHz.

Second Exemplary Embodiment

Figure 8:
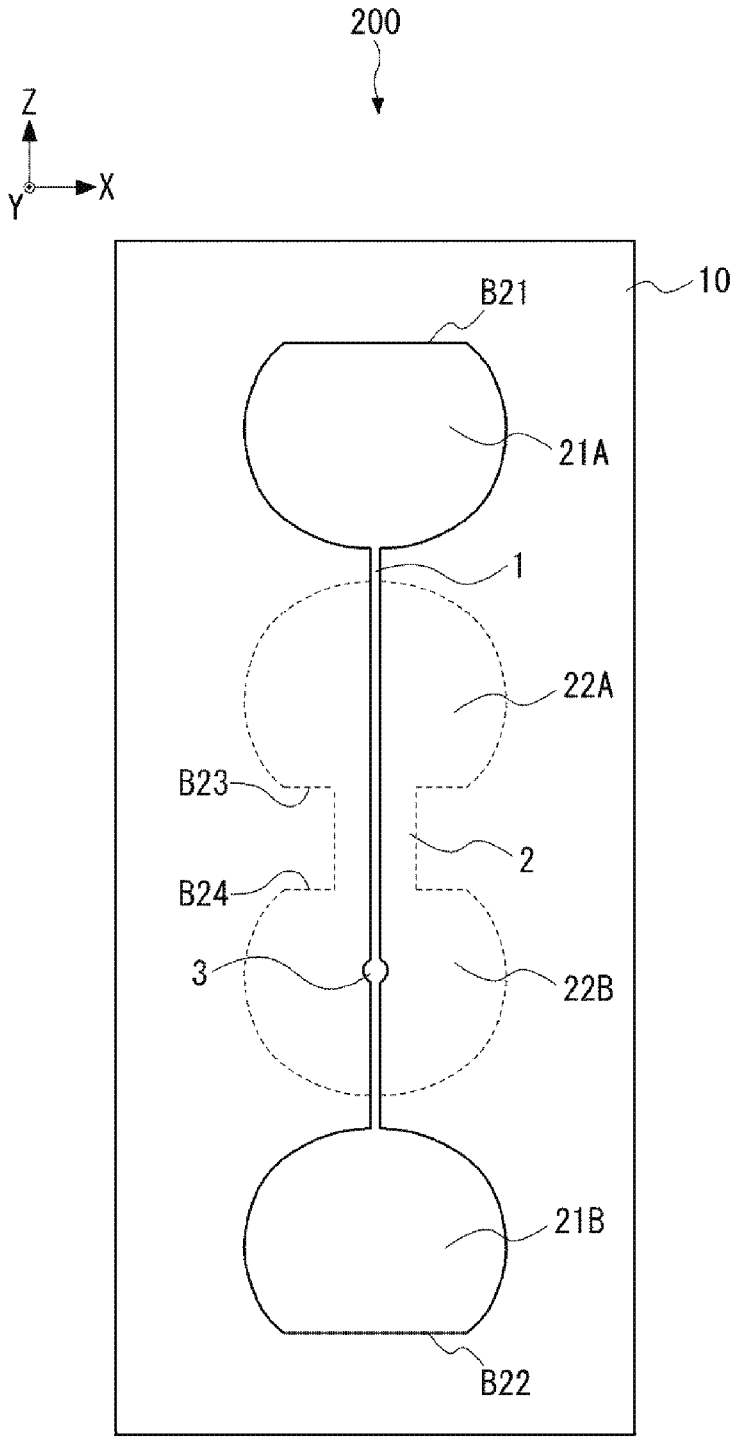
FIG. 8 is a top view of an antenna according to a second exemplary embodiment.
Figure 9:
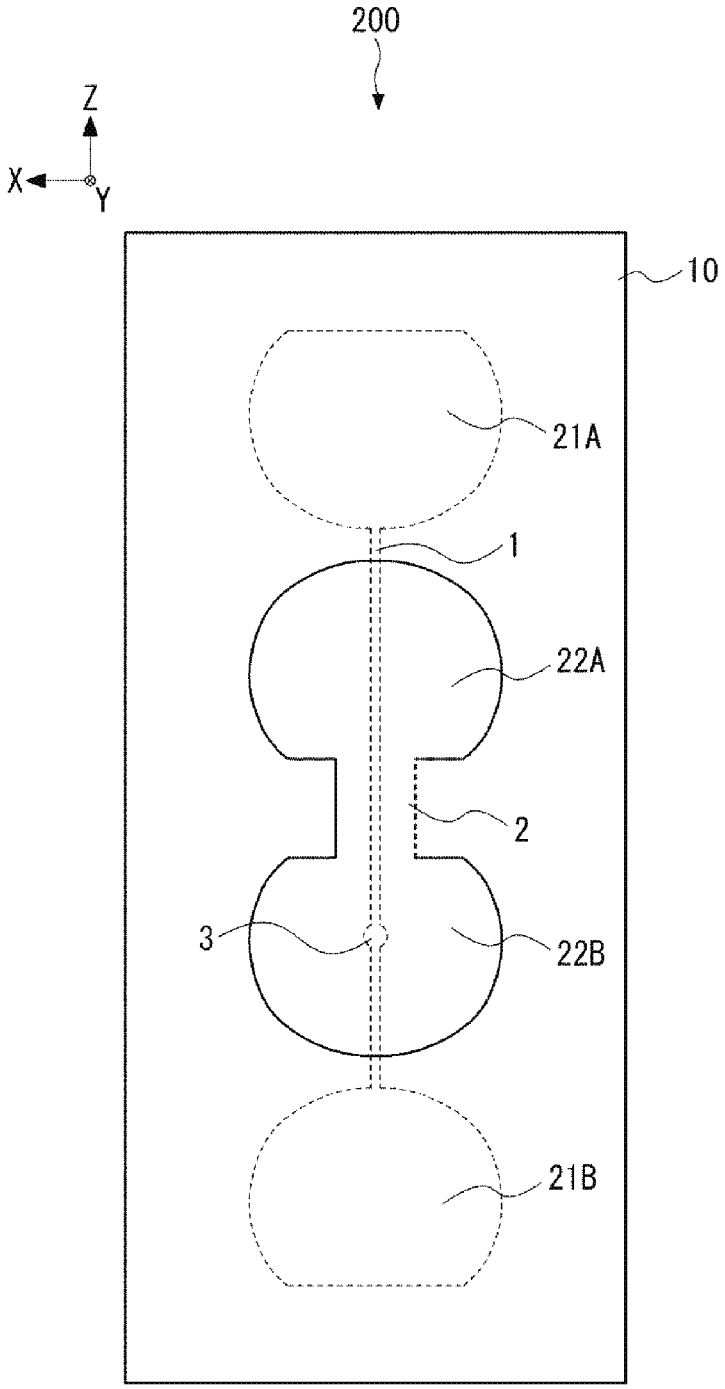
FIG. 9 is a bottom view of the antenna according to the second exemplary embodiment.

An antenna according to a second exemplary embodiment will be described. An antenna 200 according to the second exemplary embodiment is a modified example of the antenna 100 according to the first exemplary embodiment. The antenna 200 is configured as an omnidirectional antenna. FIG. 8 is a top view of the antenna 200 according to the second exemplary embodiment. FIG. 9 is a bottom view of the antenna 200 according to the second exemplary embodiment. In FIGS. 8 and 9, as in FIGS. 1 and 2, the horizontal direction of the drawing is the X axis, the vertical direction of the drawing is the Z axis, and the direction perpendicular to the drawing is the Y axis.

The antenna 200 has a configuration in which the radiation elements 11A, 11B, 12A and 12B of the antenna 100 are replaced with radiation elements 21A, 21B, 22A and 22B, respectively. Hereinafter, as in the first exemplary embodiment, the radiation elements 21A, 21B, 22A and 22B are also referred to as the first to fourth radiation elements, respectively.

Figure 10:
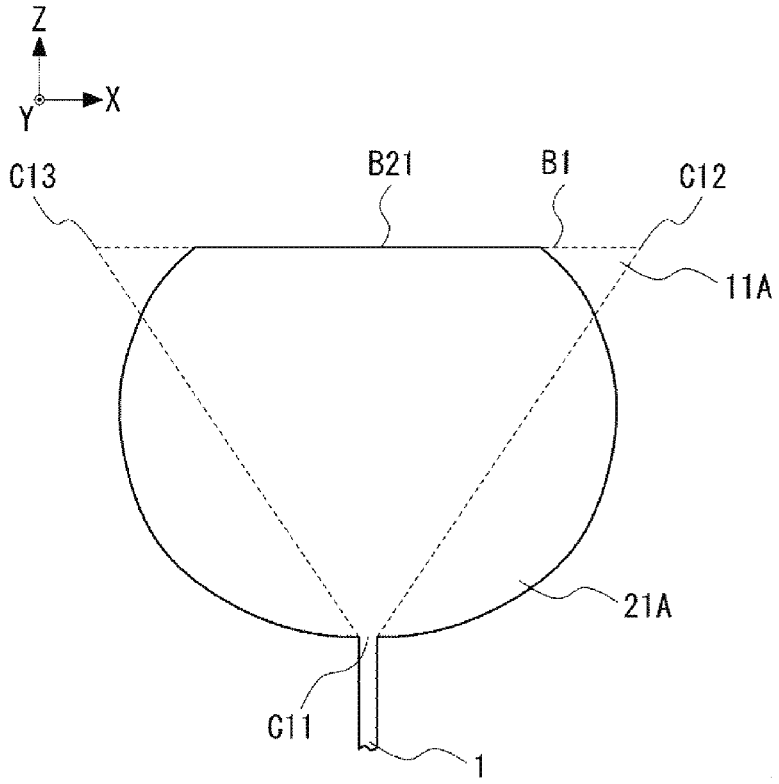
FIG. 10 is a comparative diagram between a radiation element of the antenna according to the second exemplary embodiment and the radiation element of the antenna according to the first exemplary embodiment.

The radiation element 21A will be described as a representative example below. The radiation element 21A has a shape in which the vertex of the radiation element 11A is rounded. FIG. 10 is a comparative diagram between the radiation element 21A of the antenna 200 according to the second exemplary embodiment and the radiation element 11A of the antenna 100 according to the first exemplary embodiment. A base B21 of the radiation element 21A corresponding to the base B1 of the radiation element 11A is kept in a straight line. Although a profile is sharply bent at the vertices C12 and C13 at both ends of the base B1 of the radiation element 11A, a profile gradually changes while drawing a curve line at both ends of the base B21 of the radiation element 21A. Even at a position corresponding to the vertex C11 of the radiation element 11A, the profile of the radiation element 21A gradually changes while drawing the curve line. In other words, the radiation element 21A has a profile shape in which a part of a circle is replaced with a straight line. Further, in other words, it can be understood that the shape of the radiation element 21A has a curved profile projecting to the Z axis direction from the base.

Since shapes of the radiation elements 21B, 22A and 22B are similarly modified shapes of the radiation elements 11B, 12A and 12B, descriptions of those will be omitted.

In the present configuration, there is a path through which a current flows along a profile line of the radiation element, and a resonant length of the antenna is variable. Therefore, even under a predetermined constraint of the antenna size, it is possible to design the antenna capable of operating in the wide bandwidth. Additionally, it is possible to adjust the antenna to operate at a desirable center frequency by changing a curvature of the profile line. Therefore, characteristics impedance can be easily adjusted.

Third Exemplary Embodiment

Figure 11:
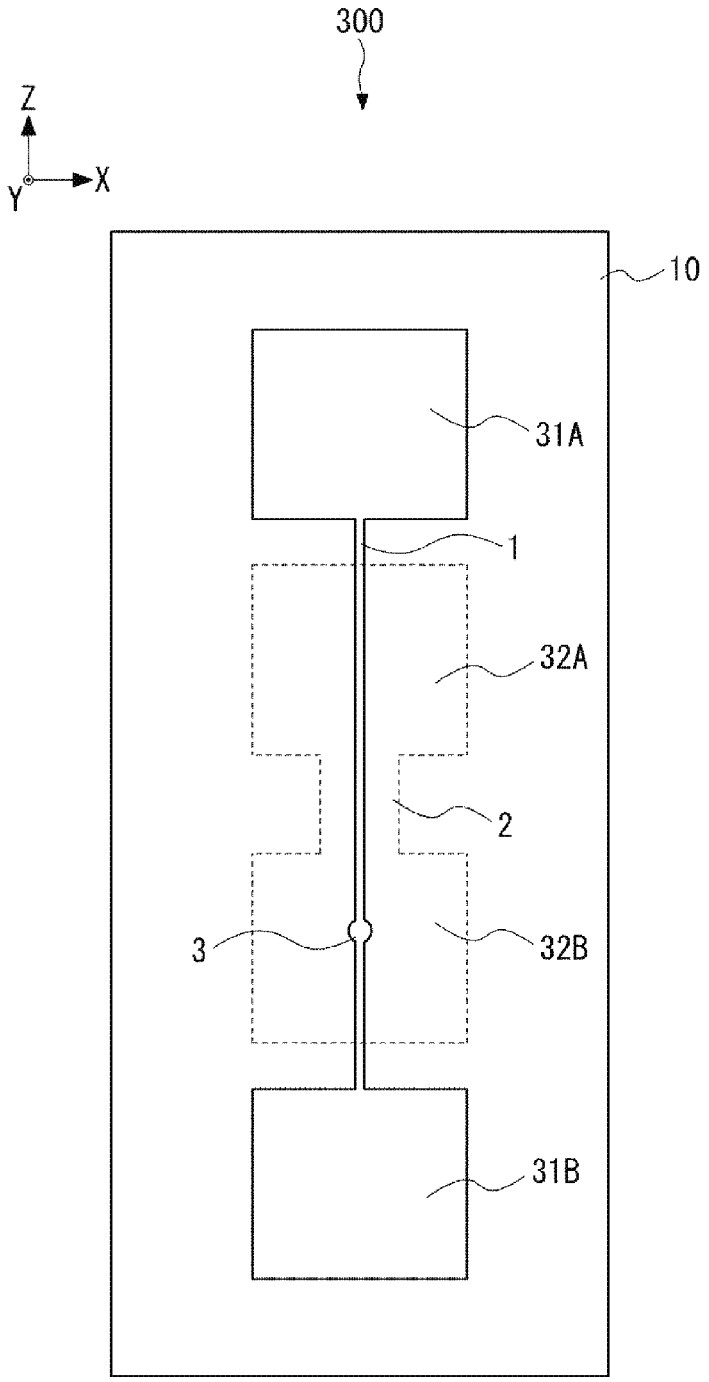
FIG. 11 is a top view of an antenna according to a third exemplary embodiment.
Figure 12:
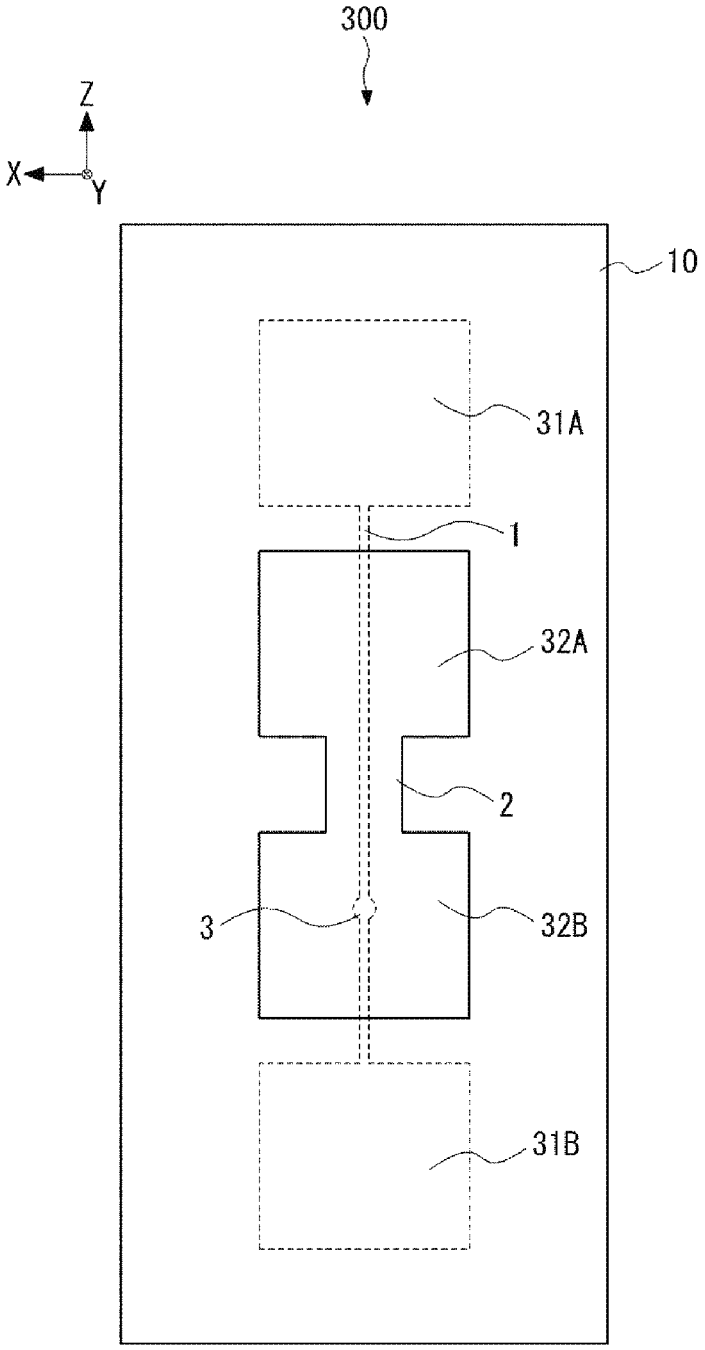
FIG. 12 is a bottom view of the antenna according to the third exemplary embodiment.

An antenna according to a third exemplary embodiment will be described. An antenna 300 according to the third exemplary embodiment is a modified example of the antenna 100 according to the first exemplary embodiment and is configured as an omnidirectional antenna. FIG. 11 is a top view of the antenna 300 according to the third exemplary embodiment. FIG. 12 is a bottom view of the antenna 300 according to the third exemplary embodiment. In FIGS. 11 and 12, as in FIGS. 1 and 2, the horizontal direction of the drawing is the X axis, the vertical direction of the drawing is the Z axis, and the direction perpendicular to the drawing is the Y axis.

The antenna 300 has a configuration in which the radiation elements 11A, 11B, 12A and 12B of the antenna 100 are replaced with radiation elements 31A, 31B, 32A and 32B, respectively. Hereinafter, as in the first exemplary embodiment, the radiation elements 31A, 31B, 32A and 32B are also referred to as the first to fourth radiation elements, respectively. The radiation elements 31A, 31B, 32A and 32B are configured as a rectangular radiation element. Since other configurations of the antenna 300 are the same as those of the antenna 100, description of those will be omitted.

According to the present configuration, a profile line can be configured as a simple rectangle. Therefore, because the resonant length of the antenna can be theoretically obtained and the characteristic impedance can be easily adjusted, it is possible to facilitate design and manufacture.

Fourth Exemplary Embodiment

An antenna according to a fourth exemplary embodiment will be described. An antenna 400 according to the fourth exemplary embodiment is a modified example of the antenna 100 according to the first exemplary embodiment and is configured as an omnidirectional antenna. The antenna 400 has a configuration in which the radiation elements 12A and 12B of the antenna 100 are replaced with radiation elements 42A and 42B, respectively. Hereinafter, as in the first exemplary embodiment, the radiation elements 42A and 42B are also referred to as the third and fourth radiation elements, respectively. Since other configurations of the antenna 400 are the same as those of the antenna 100, description of those will be omitted.

Figure 13:
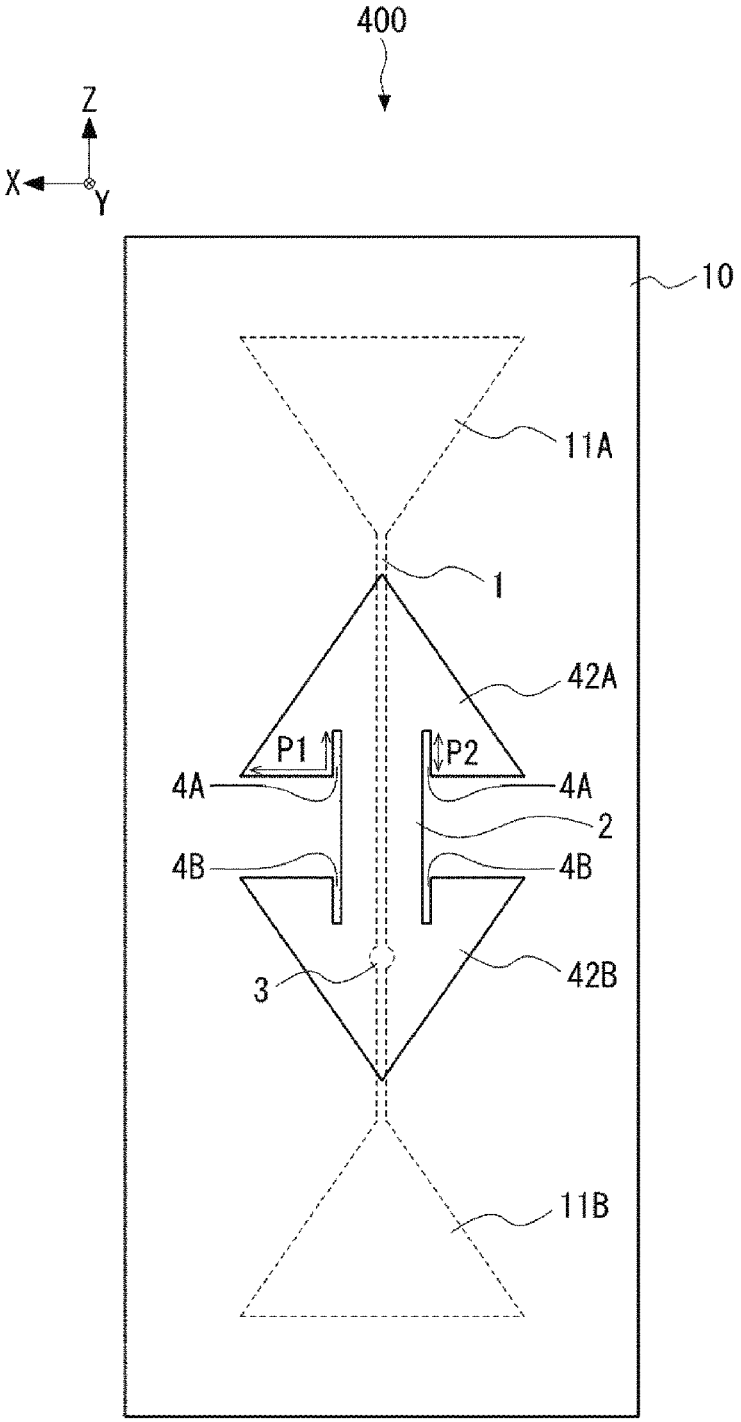
FIG. 13 is a bottom view of an antenna according to a fourth exemplary embodiment.

FIG. 13 is a bottom view of the antenna 400 according to the fourth exemplary embodiment. In FIG. 13, as in FIGS. 1 and 2, the horizontal direction of the drawing is the X axis, the vertical direction of the drawing is the Z axis, and the direction perpendicular to the drawing is the Y axis.

The radiation element 42A has a configuration in which choke grooves 4A are disposed in the radiation element 12A. The choke grooves 4A are disposed in the radiation element 42A near an end of the element connection part 2 in the X direction to suppress an undesirable current flowing through the radiation element 42A. In this example, the choke grooves 4A are disposed to extend in the Z axis direction in such a manner that the element connection part 2 is interposed between the choke grooves 4A.

For example, the choke grooves 4A may be configured in such a manner that a length of a path P1 is approximately ¼ of the effective wavelength λeff. Therefore, when an undesirable current flows through an outer perimeter of the radiation element 42A due to an effect of a radio wave radiated from the radiation element 42B, the effect due to the undesirable current can be suppressed.

Further, for example, the choke grooves 4A may be configured in such a manner that a length of a path P2 is approximately ¼ of the effective wavelength λeff. Therefore, the undesirable current flowing into a main body of the radiation element 42A can be suppressed.

The radiation element 42B has a configuration in which choke grooves 4B are disposed in the radiation element 12B. Since the choke grooves 4B are the same as the choke grooves 4A of the radiation element 42A, descriptions of those will be omitted.

As described above, according to the present configuration, it is possible to ensure isolation between two dipole antennas by disposing the choke grooves in the radiation element. Additionally, disposing the choke grooves can contribute to maintaining isotropy of directionality in the horizontal direction.

Fifth Exemplary Embodiment

Figure 14:
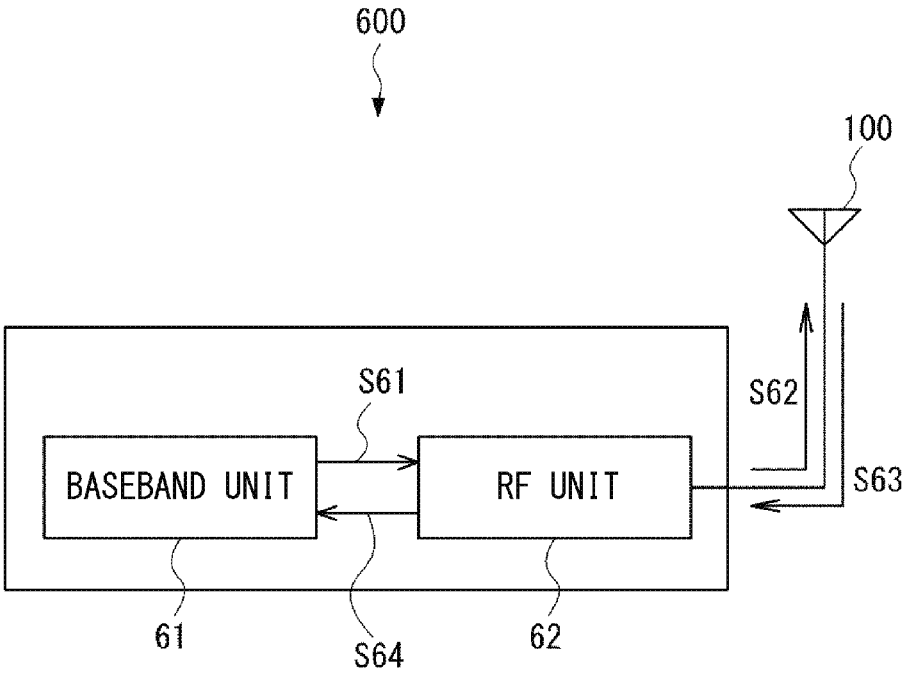
FIG. 14 is a block diagram schematically illustrating a configuration of a wireless communication apparatus according to a fifth exemplary embodiment.
Figure 15:
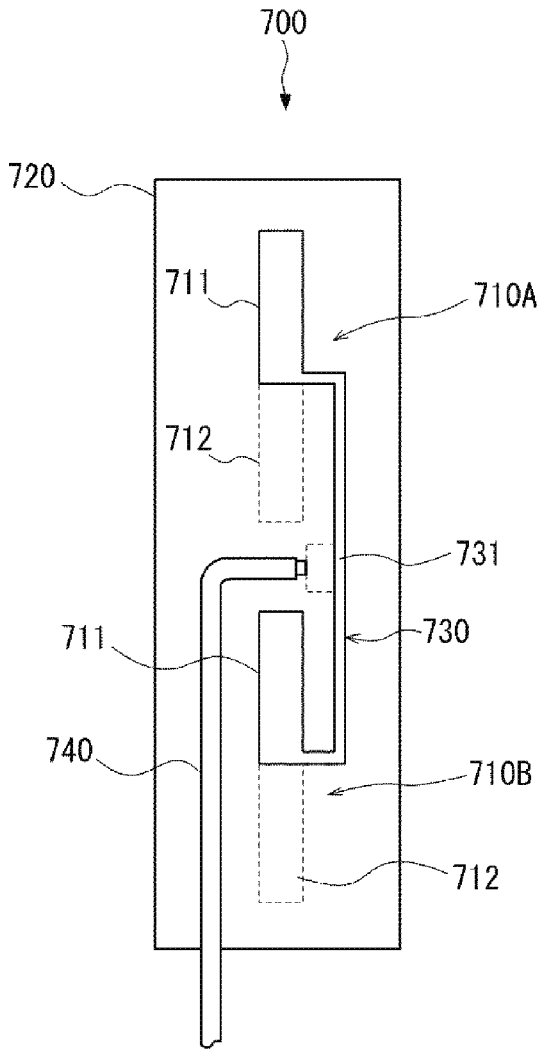
FIG. 15 is a front view illustrating a configuration of an antenna according to Patent Literature 1.
Figure 16:
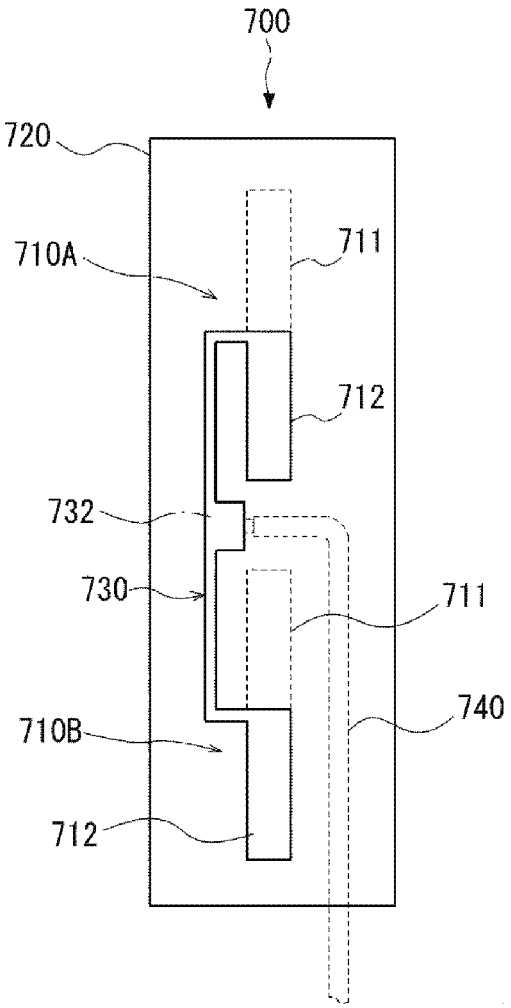
FIG. 16 is a back view illustrating the configuration of the antenna according to Patent Literature 1.
Figure 17:
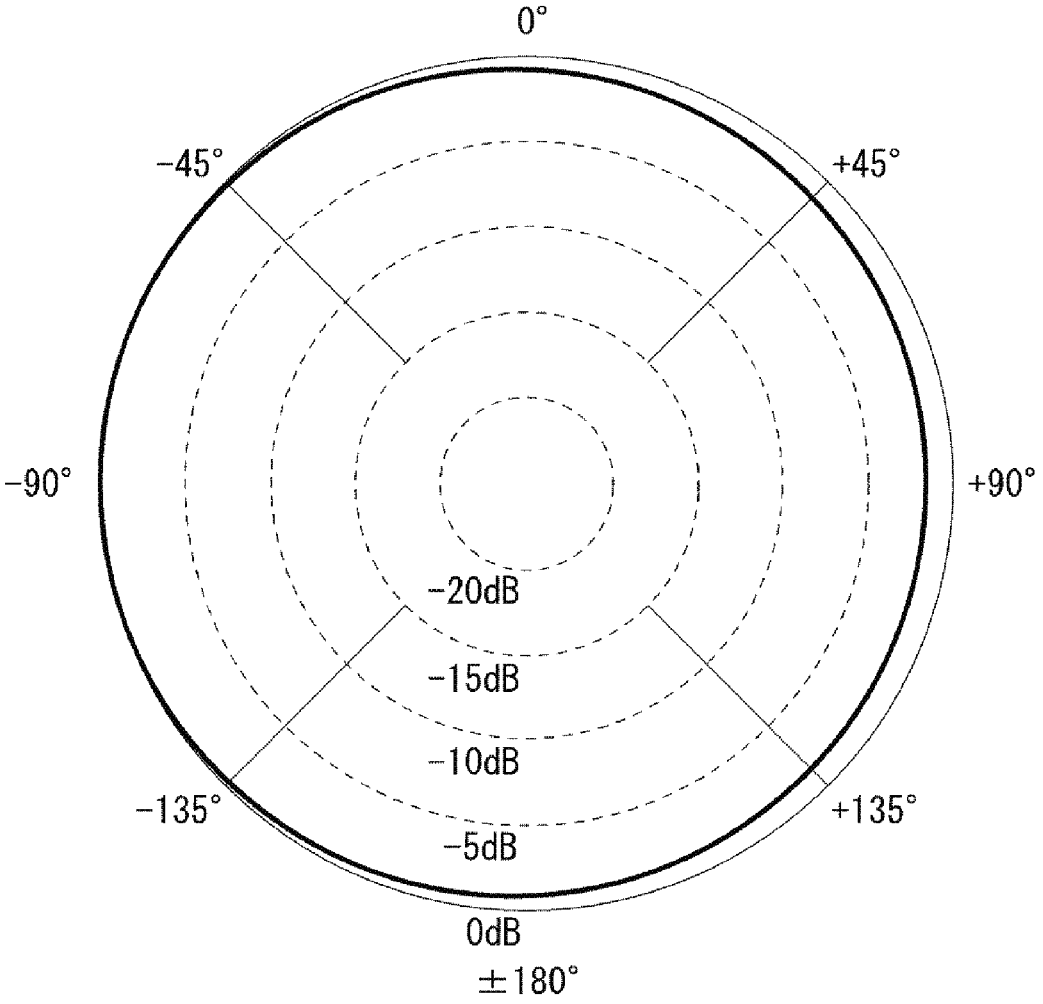
FIG. 17 illustrates a gain in a horizontal plane of the above-described omnidirectional antenna disclosed in Patent Literature 1.

A wireless communication apparatus 600 according to a fifth exemplary embodiment will be described. FIG. 14 is a block diagram schematically illustrating a configuration of the wireless communication apparatus 600 according to the fifth exemplary embodiment. The wireless communication apparatus 600 includes the antenna 100 according to the first exemplary embodiment, a baseband unit 61 and an RF unit 62. The baseband unit 61 handles a baseband signal S61 before modulation and a received signal S64 after demodulation. The RF unit 62 modulates the baseband signal S61 output from the baseband unit 61 and outputs a modulated transmission signal S62 to the antenna 100. The RF unit 62 also demodulates a received signal S63 which is received by the antenna 100 and outputs a received signal S64 after demodulation to the baseband unit 61. The antenna 100 radiates the transmission signal S62 or receives the received signal S63 radiated by an external antenna.

As described above, according to the present configuration, it can be understood that it is possible to specifically configure the wireless communication apparatus capable of performing wireless communication with the outside by using the antenna 100 according to the first exemplary embodiment.

Other Exemplary Embodiments

The present invention is not limited to the above-described exemplary embodiments, and can be modified as appropriate without departing from the scope of the invention. For example, in the exemplary embodiments described above, it has been described that the width of the element connection part in the X axis direction is smaller than the width of the radiation element in the X axis direction and, however, it is merely an example. When the width of the element connection part in the X axis direction is the same value as the width of the radiation element in the X axis direction, although an extent of omnidirectionality deteriorates with respect to the antennas according to the exemplary embodiments described above, it is possible to similarly configure an antenna that can be used as an omnidirectional antenna.

It should be appreciated that the antenna mounted in the wireless communication apparatus is not limited to the antenna 100 according to the first exemplary embodiment and the antenna according to the exemplary embodiments described above other than the antenna 100 can be used for configuring the wireless communication apparatus in the same manner.

The antenna and the wireless communication apparatus according to the exemplary embodiments described above are applicable to a wireless LAN (Local Area Network), an access point, a base station or the like. In other words, the antenna and the wireless communication apparatus according to the exemplary embodiments described above are applicable to communication for a terminal (a mobile terminal). In backhaul, the antenna and the wireless communication apparatus according to the exemplary embodiments described above are applicable to communication between the base stations. Further, the antenna and the wireless communication apparatus according to the exemplary embodiments described above can be provided for various communication methods such as LTE (Long Term Evolution).

The present invention has been described above with reference to the exemplary embodiments, but the present invention is not limited to the above exemplary embodiments. The configuration and details of the present invention can be modified in various ways which can be understood by those skilled in the art within the scope of the invention.

REFERENCE SIGNS LIST

1 MICRO STRIP LINE
2 ELEMENT CONNECTION PART

3 FEEDING UNIT
4A, 4B CHOKE GROOVES
10 PRINTED CIRCUIT BOARD
11A, 11B, 12A, 12B, 21A, 21B, 22A, 22B, 31A, 31B, 32A, 32B, 42A, 42B RADIATION ELEMENTS
61 BASEBAND UNIT
62 RF UNIT
710A, 710B ANTENNA ELEMENTS
711, 712 ELEMENT CONDUCTORS
100, 200, 300, 400, 700 ANTENNAS
600 WIRELESS COMMUNICATION APPARATUS
720 DIELECTRIC SUBSTRATE
730 DISTRIBUTION FEED LINE
731, 732 CONDUCTOR LINES
740 COAXIAL CABLE
CNT CENTER POINT

The invention claimed is:

1. An antenna comprising:

first and second radiation elements formed on a first face parallel to a first direction and a second direction orthogonal to the first direction, and arranged in the first direction;

a third radiation element formed on a second face parallel to the first face and separated from the first face in a third direction orthogonal to the first and second directions so as to be interposed between the first radiation element and the second radiation element;

a fourth radiation element formed on the second face to be interposed between the first radiation element and the second radiation element and to be closer to the second radiation element than the third radiation element;

a first line connecting the first radiation element and the second radiation element and formed on the first face to extend in the first direction;

a first element connecting part formed on the second face to overlap with the first line in the third direction, connecting the third radiation element and the fourth radiation element, and having a width in the second direction wider than that of the first line; and a feeding unit connecting a coaxial cable feeding power from the outside to the first line and the fourth radiation element, wherein the coaxial cable is connected to the feeding unit to extend from the feeding unit in the second direction and to pass through a hole disposed in one of the first line and the fourth radiation element, and one of an inner conductor and an outer conductor of the coaxial cable is electrically connected to the first line and the other of the inner conductor and the outer conductor of the coaxial cable is electrically connected to the fourth radiation element.

2. The antenna according to claim 1, wherein the first to fourth radiation elements have the same shape, and centers of the first to fourth radiation elements are aligned on a straight line in the first direction.

3. The antenna according to claim 2, wherein a distance between a center point between the third and fourth radiation elements and the center of each of the third and fourth radiation elements in the first direction is ½ of an effective wavelength of the power fed to the feeding unit in the antenna, a distance between the center point and the center of each of the first and second radiation elements in the first direction is ¾ of the effective wavelength, and the feeding unit is disposed to be shifted in the first direction by ¼ of the effective wavelength.

4. The antenna according to claim 3, wherein profiles of the first to fourth radiation elements are triangular, the first radiation element and the third radiation element constitute one bow-tie antenna, and the second radiation element and the fourth radiation element constitute one bow-tie antenna.

5. The antenna according to claim 4, wherein first to fourth sides that are respectively sides of the first to fourth radiation elements are parallel to the second direction, a first vertex separated from the first side of the first radiation element is positioned at a position closer to the third radiation element than the first side on the straight line, a second vertex separated from the second side of the second radiation element is positioned at a position closer to the fourth radiation element than the second side on the straight line, a third vertex separated from the third side of the third radiation element is positioned at a position closer to the first radiation element than the third side on the straight line, and a fourth vertex separated from the fourth side of the fourth radiation element is positioned at a position closer to the second radiation element than the fourth side on the straight line.

6. The antenna according to claim 3, wherein profiles of the first to fourth radiation elements are rectangular.

7. The antenna according to claim 6, wherein each side of the rectangle that is the profile of each of the first to fourth radiation elements is parallel to one of the first direction and the second direction.

8. The antenna according to claim 3, wherein two grooves are formed in the third radiation element to extend from a side of the third radiation element that is closest to the fourth radiation element to the first radiation element, the first element connection part being interposed between the two grooves of the third radiation element, and two grooves are formed in the fourth radiation element to extend from a side of the fourth radiation element that is closest to the third radiation element to the second radiation element, the first element connection part being interposed between the two grooves of the fourth radiation element.

9. The antenna according to claim 8, wherein a distance of a path from one end of the side of the third radiation element that is closest to the fourth radiation element to an end of the groove on a side of the first radiation element is ¼ of the effective wavelength.

10. The antenna according to claim 8, wherein a distance from the side of the third radiation element that is closest to the fourth radiation element to an end of the groove on a side of the first radiation element is ¼ of the effective wavelength.

11. The antenna according to claim 3, wherein a profile of each of the first to fourth radiation elements includes:

a straight line part parallel to the second direction; and a curved line part projecting in a direction parallel to the first direction and connecting both ends of the straight line part, the curved line part included in the profile of the first radiation element projects to the third radiation element, the curved line part included in the profile of the second radiation element projects to the fourth radiation element, the curved line part included in the profile of the third radiation element projects to the first radiation element, and the curved line part included in the profile of the fourth radiation element projects to the second radiation element.

12. The antenna according to claim 1, further comprising a printed circuit board, wherein the first face is one face of the printed circuit board and the second face is the other face of the printed circuit board, and the feeding unit is formed to penetrate the printed circuit board.

13. A wireless communication apparatus comprising:

an antenna configured to be capable of corresponding to a plurality of frequencies;

a base band unit configured to output a base band signal and receive a signal generated by demodulating a received signal; and a RF unit configured to modulate the base band signal and output a transmission signal to the antenna, and to output the signal generated by demodulating the received signal received from the antenna to the base band unit, wherein the antenna comprises:

first and second radiation elements formed on a first face parallel to a first direction and a second direction orthogonal to the first direction and arranged in the first direction;

a third radiation element formed on a second face parallel to the first face and separated from the first face in a third direction orthogonal to the first and second directions so as to be interposed between the first radiation element and the second radiation element;

a fourth radiation element formed on the second face to be interposed between the first radiation element and the second radiation element and to be closer to the second radiation element than the third radiation element;

a first line connecting the first radiation element and the second radiation element and formed on the first face to extend in the first direction;

a first element connecting part formed on the second face to overlap with the first line in the third direction, connecting the third radiation element and the fourth radiation element, and having a width in the second direction wider than that of the first line; and a feeding unit connecting a coaxial cable feeding power from the outside to the first line and the fourth radiation element, wherein the coaxial cable is connected to the feeding unit to extend from the feeding unit in the second direction and to pass through a hole disposed in one of the first line and the fourth radiation element, and one of an inner conductor and an outer conductor of the coaxial cable is electrically connected to the first line and the other of the inner conductor and the outer conductor of the coaxial cable is electrically connected to the fourth radiation element.

* * * * *